United States Patent [19]

Galow et al.

[11] Patent Number: 4,468,288

[45] Date of Patent: Aug. 28, 1984

[54] METHOD OF PREHEATING COAL AND SUPPLYING PREHEATED COAL TO A COKE OVEN

[75] Inventors: Manfred Galow; Claus Flockenhaus, both of Essen; Joachim Meckel, Heiligenhaus; Horst G. Joseph, Essen; Günter Gabriel, Datteln, all of Fed. Rep. of Germany

[73] Assignee: Didier Engineering GmbH, Essen, Fed. Rep. of Germany

[21] Appl. No.: 358,798

[22] Filed: Mar. 16, 1982

[30] Foreign Application Priority Data

Mar. 19, 1981 [DE] Fed. Rep. of Germany ..... 3110662

[51] Int. Cl.[3] ..... C10B 31/08; C10B 57/10

[52] U.S. Cl. ..... 201/41; 34/10; 201/43; 202/262; 432/15

[58] Field of Search ..... 201/31, 33, 41, 43; 202/262, 270; 34/10, 51 R; 414/160, 786; 432/14, 15, 58

[56] References Cited

U.S. PATENT DOCUMENTS

| | | | |
|---|---|---|---|
| 2,903,400 | 9/1959 | Poindexter et al. . | |
| 3,374,151 | 3/1968 | Schmidt | 202/262 |
| 3,800,427 | 4/1974 | Kemmetmueller . | |
| 3,884,620 | 5/1975 | Rammler | 201/31 |
| 3,951,750 | 4/1976 | Drebes | 202/262 |
| 4,202,733 | 5/1980 | Luke et al. | 201/41 |
| 4,238,891 | 12/1980 | Fach et al. | 34/57 R |
| 4,295,281 | 10/1981 | Potter | 34/10 |
| 4,356,063 | 10/1982 | Corry | 202/262 |
| 4,369,094 | 1/1983 | Flockenhaus et al. | 202/262 |

FOREIGN PATENT DOCUMENTS

| | | |
|---|---|---|
| 1139439 | 11/1962 | Fed. Rep. of Germany . |
| 1194365 | 6/1965 | Fed. Rep. of Germany . |

*Primary Examiner*—Bradley Garris

*Attorney, Agent, or Firm*—Wenderoth, Lind & Ponack

[57] ABSTRACT

Moist bulk coal is supplied into a fluidized bed drier into which is introduced a first heat carrier gas to thereby dry the moist coal to form dried coal. The dried coal is discharged from the drier and is transferred to a generally horizontal bulk material conveyor. A second heat carrier gas is injected through the bottom of the bulk material conveyor, thereby transporting the coal generally horizontally and preheating the coal to form preheated coal. The preheated coal is then discharged from the bulk material conveyor and is filled into a selected charging opening of a coke oven battery.

4 Claims, 2 Drawing Figures

METHOD OF PREHEATING COAL AND SUPPLYING PREHEATED COAL TO A COKE OVEN

BACKGROUND OF THE INVENTION

The present invention relates to a method of preheating coal and for supplying the thus preheated coal to a coke oven.

Conventionally, granular or bulk coal to be used in forming coke is dried and preheated in so called counterflow pipes. Inside such pipes, the coal is dried and preheated by a counterflow of a heat carrier gas. The preheated coal is then moved by a conveyor to a coking chamber, if necessary after a prior intermediate storage period.

SUMMARY OF THE INVENTION

It is the object of the present invention to provide a simpler and more rational system for preheating coal and for supplying the thus preheated coal to coke ovens, while achieving lower installation and operating costs than in the conventional system.

This object is achieved in accordance with the present invention by the provision of a method whereby moist granular or bulk coal is supplied into a fluidized bed drier into which is introduced a first heat carrier gas to fluidize the bed of granular coal and thereby to dry the moist coal to form dried coal. The dried coal is then discharged from the drier and transferred to a generally horizontal bulk material conveyor. A second heat carrier gas is injected through the bottom of the bulk material conveyor, thereby fluidizing and transporting the coal generally horizontally along the conveyor and preheating the coal to form preheated coal. The preheated coal is then discharged from the conveyor and is filled into a selected charging opening of a coke oven battery. By this system in accordance with the present invention the horizontal conveying path or route itself is employed to preheat the coal.

In accordance with one arrangement of the present invention, the dried coal is discharged from the drier into an intermediate storage area and is then transferred when necessary from the intermediate storage area to the bulk material conveyor. In this arrangement, the preheated coal is filled into the charging opening from the bulk material conveyor. In accordance with an alternative arrangement, the dried coal is discharged from the drier to the bulk material conveyor. The preheated coal is discharged from the bulk material conveyor into an intermediate storage area, and when necessary the preheated coal is fed from the intermediate storage area to the charging opening.

In accordance with a further feature of the present invention, a fine grain portion of the coal is removed from the fluidized bed of the drier, is compacted, and is then returned to the fluidized bed of the drier.

In accordance with an even further feature of the present invention, the first heat carrier gas, after being cooled in the drier, is removed from the drier by means of a blower. This blower may by used to remove the fine grain portion of the coal from the drier, after which the fine grain poriton is separated from the cooled first heat carrier gas. At least a portion of the cooled first heat carrier gas which is removed from the drier may be added to the first heat carrier gas introduced into the drier, thereby to adjustably regulate and control the temperature of the gas introduced into the drier, and thereby the temperature of the fluidized bed. Also, at least a portion of the cooled first heat carrier gas removed from the drier may be added to the heat carrier gas which is injected into the conveyor, thereby to adjustably regulate and control the temperature of the second heat carrier gas used to preheat the coal.

In accordance with the present invention, the heat carrier gas employed in the fluidized bed drier and in the bulk material conveyor preheater is any gas composition known in the art for drying and/or preheating coal. Such gas is inert to the coal and thus has a low oxygen content, mainly consisting of nitrogen, carbon dioxide and water vapor.

The bulk material conveyor into which is injected the preheating heat carrier gas may be equipped with so called "Polysius" grooves. Also, the conveying route from the intermediate storage area to the charging opening of the coke oven battery may be constructed in the manner of the so called revolving "coffee mill" design, as disclosed in U.S. patent application Ser. No. 934,548 now abandoned, corresponding to West German patent application No. 27 38 059. In this system, there is provided several fluid conveyors. The connections between the grooves of the conveyors are rotatable in the vertical and horizontal direction so that it is possible to reach with the outlet of the system every charging opening of a coke oven battery.

BRIEF DESCRIPTION OF THE DRAWINGS

Other objects, features and advantages of the present invention will be apparent from the following detailed description of preferred embodiments thereof, without being limited thereto, and with reference to the accompanying drawings, wherein.

DETAILED DESCRIPTION OF THE INVENTION

Figure 1:
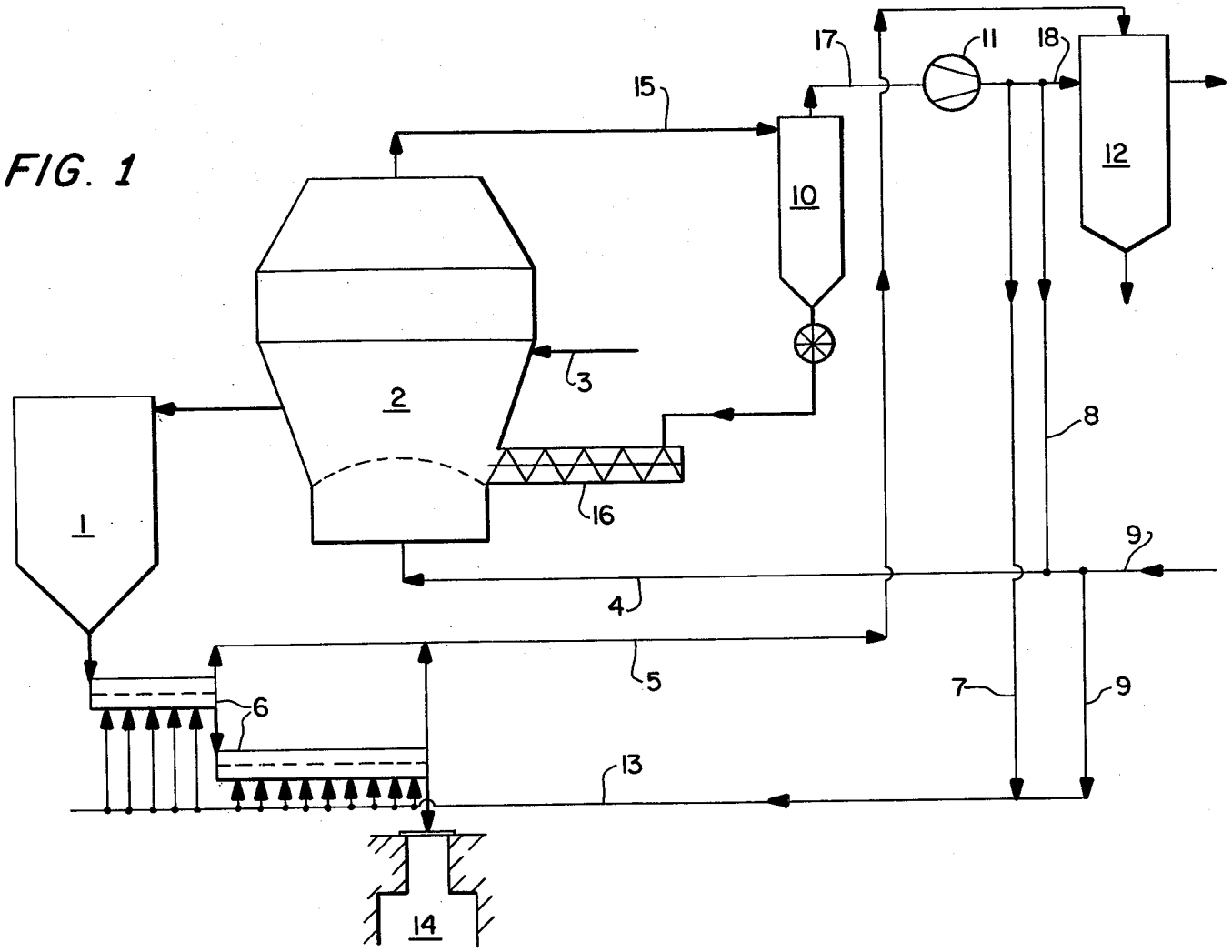
FIG. 1 is a schematic flow diagram of a system in accordance with a first embodiment of the present invention.

With reference to FIG. 1, a first embodiment of the present invention will be described. Thus, moist granular coal is introduced at 3 into a fluidized bed drier 2, the internal construction of which will be apparent to those skilled in the art. A first heat carrier gas is introduced at 4 into the drier 2 and thereby fluidizes the bed of granular coal within the drier 2 and dries the granular coal to form dried coal. The dried coal is transferred to an intermediate storage area 1, such as a bulk storage container of known construction. The dried coal is transferred from intermediate storage area 1 to a bulk material conveyor 6. Second heat carrier gas is injected from 13 into the horizontal segments of conveyor 6. This second heat carrier gas thereby transports the coal through conveyor 6 and fluidizes the coal therein and preheats the coal to form preheated coal. The preheated coal is discharged from conveyor 6 and is filled into a selected charging opening into a coke oven chamber 14 of a coke oven battery.

The horizontal segments of conveyor 6 may be designed as so called "Polysius" grooves. A portion of conveyor 6 may be a feed device which may be in the form of the known revolving "coffee mill" design as disclosed in U.S. patent application Ser. No. 934,548, corresponding to West German patent application No. 27 38 059.

Both heat carrier gases 4 and 13 are gases of a composition known in the art for drying and preheating bulk coal, are inert to the coal, and have a low oxygen content. Such gases conventionally mainly consist of nitrogen, carbon dioxide and water vapor. Both the first heat carrier gas 4 and the second heat carrier gas 13 can be supplied from a single heat carrier gas source 9.

A blower 11 removes at 15 the first heat carrier gas which is cooled in the drier 2 as well as coal fines, i.e. a fine grain portion of the coal. The fine grain portion of the coal is separated from the cooled first heat carrier gas in a separator 10 and is then compacted in a compactor 16 and is then returned to the fluidized bed in the drier 2. The cooled heat carrier gas which is separated from the coal fines is supplied at 17 through blower 11 and separates on the pressure side of blower 11 into three partial flows. One partial flow 8 is mixed with the hot first heat carrier gas 4 and is returned to the fluidized bed drier as reverse vapor, thereby enabling adjustable regulation and control of the temperature of the drying gas. Preferably, the temperature of the gas 4 entering the drier 2 should be about 250° C. and should not exceed such value. The second cold partial flow 7 is added to the second heat carrier gas at 13 which is injected into the conveyor 6, such as into the "Polysius" grooves thereof. Thereby, it is possible to adjustably regulate and control the temperature of the gas introduced into the conveyor 6 to be at an approximate maximum temperature of 400° C.

In accordance with the filling rhythm of the coke ovens involved, the preheating stage operates intermittently. A regulator insures that the drying process in the fluidized bed drier 2 is shut off while the coal is preheated in the conveyor 6. The third partial flow of cooled gas at 18 and the cooled second heat carrier after having conveyed the coal through the conveyor 6 and preheated the coal are passed through a filtering device 12 and are then discharged. Filtering device 12 removes water vapor which previously had been removed from the coal.

Figure 2:
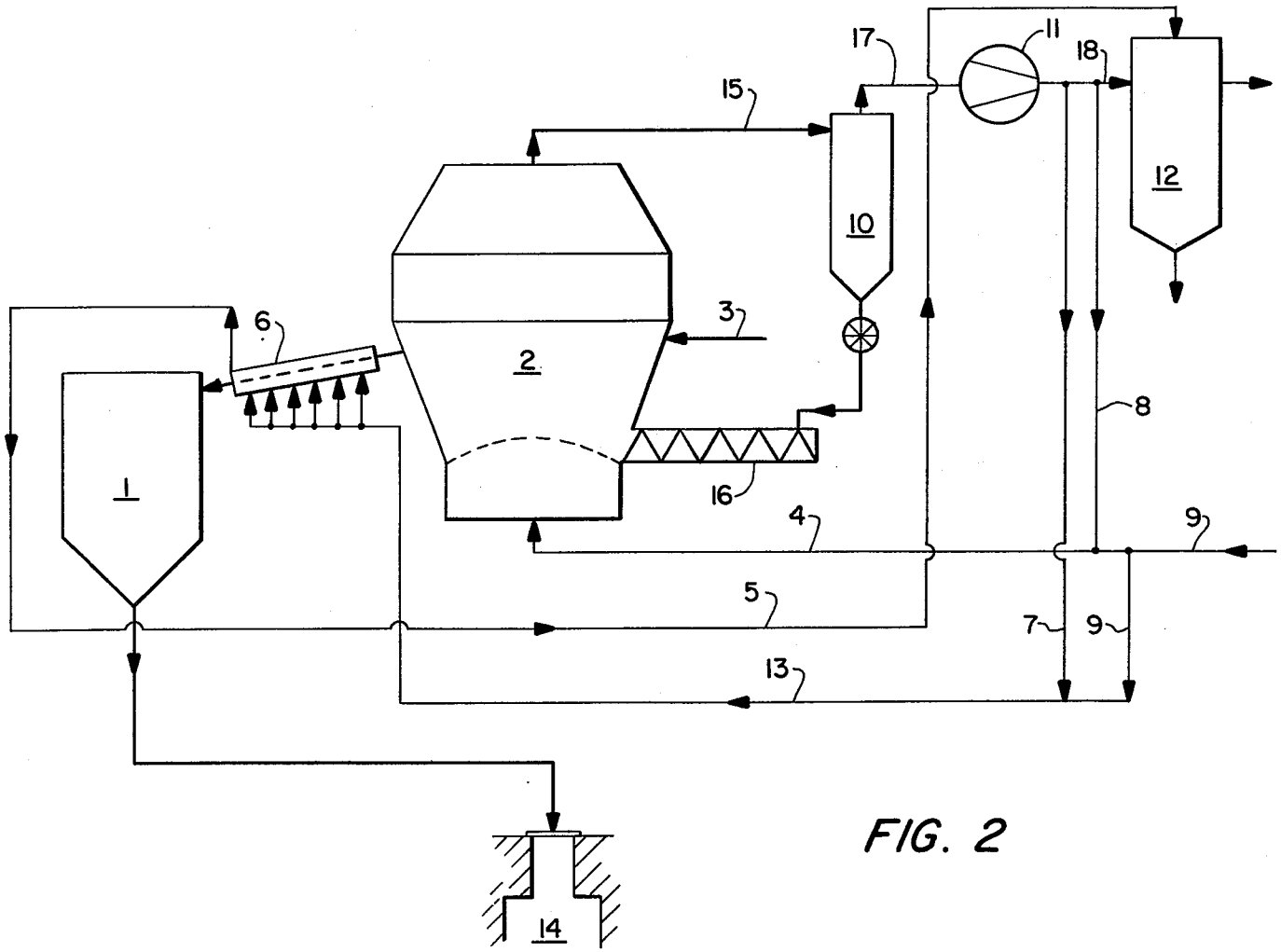
FIG. 2 is a schematic flow diagram of a system in accordance with a second embodiment of the present invention.

The embodiment of FIG. 2 differs from the embodiment of FIG. 1 in that the dried coal is discharged from the drier 2 directly to the preheating conveyor 6 and is then passed to intermediate storage area 1. When necessary, the preheated coal is fed from intermediate storage area 1 to the charging opening of a coke oven chamber 14. The coal may be fed to oven chamber 14 either by a fixed coal feeder of conventional design or by a coal feeder of the revolving "coffee mill" design as discussed above.

Although the present invention has been described and illustrated with regard to preferred embodiments thereof, it is to be understood that various modifications and alterations may be made to the specifically described and illustrated arrangements without departing from the scope of the present invention. It specifically is to be understood that the bulk material conveyor 6 and the device which feeds the preheated coal to the coke oven chamber 14 may be any structure capable of achieving such functions, given the relative locations and positions of the other elements of the system. The important feature of the present invention involves drying of the coal in a fluidized bed drier 2 and preheating of the coal while conveying it horizontally to a position of storage [FIG. 2] or utilization [FIG. 1], while injecting a preheating heat carrier gas through the bottom of the horizontal sections of the conveyor. It specifically is advantageous in accordance with the present invention that the heat carrier gas injected into the bottom of horizontal sections of the bulk material conveyor fluidize and preheat the coal. Additional important features of the present invention involve the manner of regulation of the temperatures of the heat carrier gases at 4 and 13 by means of the cooled drier heat carrier gas.

What we claim is:

1. A method of preheating coal and supplying the thus preheated coal to a coke oven, said method comprising:

supplying moist coal into a fluidized bed drier;

introducing a low oxygen content first heat carrier gas into said drier in direct contact with said moist coal and thereby fluidizing and drying said moist coal to form dried coal;

discharging said dried coal from said drier;

transferring said dried coal to a generally horizontal bulk material conveyor;

injecting a low oxygen contact second heat carrier gas through the bottom of said bulk material conveyor, and thereby transporting said coal generally horizontally and preheating said coal to form preheated coal;

discharging said preheated coal from said bulk material conveyor;

filling said preheated coal into a selected charging opening of a coke oven battery;

removing said first heat carrier gas, after being cooled in said drier, from said drier;

adding a first portion of said cooled and removed first heat carrier gas to said first heat carrier gas introduced into said drier, and thereby adjustably controlling the temperature of said drier; and adding a second portion of said cooled and removed first heat carrier gas to said second heat carrier gas injected into said conveyor, and thereby adjustably controlling the temperature of said second heat carrier gas used to preheat said coal.

2. A method as claimed in claim 1, wherein said dried coal is discharged from said drier into an intermediate storage area, said dried coal is transferred from said intermediate storage area to said bulk material conveyor, and said preheated coal is filled into said charging opening directly from said bulk material conveyor.

3. A method as claimed in claim 1, wherein said dried coal is discharged from said drier to said bulk material conveyor, said preheated coal is discharged from said bulk material conveyor into an intermediate storage area, and said preheated coal is fed from said intermediate storage area to said charging opening.

4. A method as claimed in claim 1, further comprising removing a fine grain portion of said coal from said drier, compacting said fine grain portion, and then returning the thus compacted coal to said drier.

* * * * *